US009498820B2

(12) United States Patent
Fan et al.

(10) Patent No.: US 9,498,820 B2
(45) Date of Patent: Nov. 22, 2016

(54) APPARATUS AND METHOD FOR LIQUID METALS TREATMENT

(75) Inventors: Zhongyun Fan, Uxbridge Middlesex (GB); Bo Jiang, Uxbridge Middlesex (GB); Yubo Zuo, Uxbridge Middlesex (GB)

(73) Assignee: Brunel University (GB)

( * ) Notice: Subject to any disclaimer, the term of this patent is extended or adjusted under 35 U.S.C. 154(b) by 730 days.

(21) Appl. No.: 13/823,216

(22) PCT Filed: Sep. 16, 2011

(86) PCT No.: PCT/GB2011/051744
§ 371 (c)(1),
(2), (4) Date: May 22, 2013

(87) PCT Pub. No.: WO2012/035357
PCT Pub. Date: Mar. 22, 2012

(65) Prior Publication Data

US 2013/0228045 A1 Sep. 5, 2013

(30) Foreign Application Priority Data

Sep. 16, 2010 (GB) ..... 1015498.7

(51) Int. Cl.
*B22D 11/10* (2006.01)
*B22D 45/00* (2006.01)
*F27D 27/00* (2010.01)

(52) U.S. Cl.
CPC ..... *B22D 11/10* (2013.01); *B22D 45/00* (2013.01); *F27D 27/00* (2013.01); *F27D 27/005* (2013.01)

(58) Field of Classification Search
CPC ..... F27D 27/00; F27D 27/005; B22D 45/00; B22D 11/10
USPC ..... 266/233, 217, 287, 286, 235, 239; 222/594; 75/708
See application file for complete search history.

(56) References Cited

U.S. PATENT DOCUMENTS 3,785,632 A 1/1974 Kraemer et al.
3,902,544 A 9/1975 Flemings et al.
(Continued)

FOREIGN PATENT DOCUMENTS

EP 1779924 A1 5/2007
EP 2006627 A1 12/2008
(Continued)

OTHER PUBLICATIONS

Nakasuga T., et al., "Development of a Continuous Desiliconization Process in the Hot Metal Runner of a Blast Furnace,", Steel Research International, Verlag Stahleisen GMBH, Dusseldorf, Germany, vol. 80, No. 8, Aug. 1, 2009, pp. 530-534.

*Primary Examiner* — Scott Kastler
*Assistant Examiner* — Michael Aboagye
(74) *Attorney, Agent, or Firm* — Craig A. Fieschko, Esq.; DeWitt Ross & Stevens S.C.

(57) ABSTRACT

This invention relates to an apparatus (high shear device) and method for treating liquid metals by intensive melt shearing. The apparatus comprises a stator and a rotor with a small gap between them to provide intensive melt shearing for dispersing efficiently and distributing uniformly gas, liquid and solid phases in liquid metals without severe turbulence at the melt surface. The device can be extended to a multistage high shear pump by arranging individual rotor/stator assemblies either concentrically (one in another) or vertically. The device and high shear pump can be readily integrated into existing casting processes. The device is suitable for use in casting processes including high pressure die casting, low pressure die casting, gravity die casting, sand casting, investment casting, direct chill casting, twin roll casting, and any other casting process which requires liquid metal as a feedstock. In addition, the device is particularly suitable for providing conditioned liquid metal for both shape casting and continuous (or semi-continuous) casting of metallic materials, preparing high quality semi-solid slurries, solidification processing of particulate reinforced metal matrix composites, mixing immiscible metallic liquids and degassing of liquid metals prior to any casting processes.

19 Claims, 10 Drawing Sheets

(56) References Cited

U.S. PATENT DOCUMENTS

| | | | | |
|---|---|---|---|---|
| 4,046,559 | A | 9/1977 | Crimes | |
| 4,116,423 | A | 9/1978 | Bennett | |
| 4,373,950 | A | 2/1983 | Shingu et al. | |
| 4,684,614 | A | 8/1987 | Krovak et al. | |
| 4,743,428 | A | 5/1988 | McRae et al. | |
| 4,908,060 | A | 3/1990 | Duenkelmann | |
| 4,960,163 | A | 10/1990 | Fang et al. | |
| 5,167,920 | A | 12/1992 | Skibo et al. | |
| 5,597,289 | A | 1/1997 | Thut | |
| 6,019,576 | A | 2/2000 | Thut | |
| 6,071,074 | A * | 6/2000 | Morando | F04D 7/065 415/178 |
| 6,533,535 | B2 * | 3/2003 | Thut | F04D 29/708 415/1 |
| 6,618,426 | B1 | 9/2003 | Ernst | |
| 2002/0146313 | A1 | 10/2002 | Thut | |
| 2006/0198725 | A1 | 9/2006 | Thut | |
| 2008/0314548 | A1 | 12/2008 | Cooper | |
| 2010/0300304 | A1 | 12/2010 | Shimizu | |
| 2012/0081990 | A1 | 4/2012 | Murata | |

FOREIGN PATENT DOCUMENTS

| | | | |
|---|---|---|---|
| WO | WO 2007/042635 | A1 | 4/2007 |
| WO | WO 2010/032550 | A1 | 3/2010 |
| WO | WO 2010/150656 | A1 | 12/2010 |

* cited by examiner

APPARATUS AND METHOD FOR LIQUID METALS TREATMENT

The present invention relates generally to liquid metal treatment prior to solidification processing of metallic materials, and in particular to a device for shearing liquid metals. The present invention provides a means to control inclusions and gaseous elements, to homogenise the melt composition and temperature, to enhance kinetics for any chemical reactions or phase transformations involving a liquid phase, to mix materials containing heterogeneous phases, to refine cast microstructures and to eliminate/reduce cast defects. This invention is applicable to a variety of casting techniques, such as high pressure die casting, low pressure die casting, gravity die casting, sand casting, investment casting, direct chill casting, twin roll casting, and any other casting process which requires liquid metal as a feedstock.

BACKGROUND OF THE INVENTION

Liquid metal treatment prior to solidification processing is necessary for a variety of casting processes including, but not limited to, sand casting, permanent mould casting, high pressure die casting, direct chill casting, twin roll casting and the like for the purposes of grain refinement, melt cleanliness, homogeneous microstructure and homogeneity of chemical composition, dispersing and distributing of both endogenous and exogenous particles.

The existing methods for liquid metal treatment mainly include, mechanical stirring by an impeller, electromagnetic stirring, and some other methods like gas induced liquid flow.

Mechanical stirring by an impeller is a very simple way to treat liquid metals. It only provides moderate melt shearing around the impeller, but causes serious vortex in the liquid metal and serious turbulence near the liquid surface, resulting in severe entrapment of gas and other contaminants from the melt surface. There have been a number of approaches to address such problems.

U.S. Pat. No. 3,785,632 issued to Kraemer et al. discloses a process and an apparatus for accelerating metallurgical reactions. The process includes mechanical stirring at the boundary between the molten bath and the reactant, using a twin-impeller. A centrifugal force component is created when the apparatus starts stirring and causes different curvature towards the margin of the ladle which leads to the acceleration of chemical reaction between the molten metallic material and the reactants.

U.S. Pat. No. 4,743,428 issued to McRae et al. discloses a method of mechanical stirring of liquid metals for producing alloys. The process introduces an agitating device mainly to accelerate the dissolution of alloying elements and slow down the formation of dross.

U.S. Pat. No. 3,902,544 issued to Flemings et al. discloses a continuous process of treating liquid metals by mechanical stirring to obtain semi-solid metallic materials with non-dendritic primary solid. In this process three augers are introduced and located in three separated agitation zones. The augers are more effective compared to the twin blade impeller. The distance between the inner surface of the agitation zone and the outer surface of the auger is kept sufficiently small so that high shear forces can be applied to the materials in the agitation zones.

U.S. Pat. No. 4,373,950 issued to Shingu et al. introduced mechanical stirring by an impeller into direct chill casting process to purify aluminium. Aluminium melt is purified by using a mechanical stirring apparatus to break down dendrites at the interface between the liquid and the solid, and dispersing the impurity released from dendrites into the whole liquid.

U.S. Pat. No. 4,908,060 issued to Duenkelmann discloses a rotary device comprising a hollow shaft and a hollow rotor attached to the shaft for dispersing gas in molten metal. The device introduces inert gas from the top of the shaft and delivers a large volume of inert gas into the melt for degassing of liquid metals.

The inventions discussed above all involve mechanical stirring. They neither provide the high shear rate required for melt conditioning, nor avoid the problems of entrapment of gas and other contaminants from the melt surface.

U.S. Pat. No. 4,960,163 introduces a mechanical stirrer in direct chill casting for achieving fine grain structure and a partition to divide the space in the DC caster into a supply reservoir and a solidification reservoir for avoiding turbulence near the liquid surface in the supply reservoir without weakening the stirring in the solidification reservoir. A certain degree of grain refinement by this invention was achieved but the results were not consistent from batch to batch.

U.S. Pat. No. 6,618,426 issued to Ernst discloses a process of electromagnetic stirring to treat liquid metals. This process used multiple coils with different directions to reduce the turbulence near the liquid surface. However, the shearing rate by electromagnetic stirring is low and the cost of the apparatus is high.

WO 2010/032550 (Nippon Light Metal Co. Ltd) discloses a metal melt refiner for use in a ladling chamber. It is essentially a multi-blade stirrer for degassing and deslagging liquid metals. However it has very little dispersing and distributing power and the whole assembly is not suitable for direct incorporation in existing casting processes.

WO 2010/150656 (Eddy Plus Co. Ltd) discloses a distributive mixing device based on centrifugal force. It has a low shear rate and insufficient power for dispersion.

EP 1 779 924 (Prosign) discloses a disk-blade mixer for distributive mixing. It has insufficient power for dispersion.

U.S. Pat. No. 4,684,614 (Ceskoslovenska akademie ved) discloses a bladeless mixer for mixing, pumping and dissipating liquid, particularly in the food industry. It would only be suitable for low temperature applications, and could not be used to shear liquid metals.

U.S. Pat. No. 4,046,559 (Kennecott Copper Corporation) discloses a disk-blade based distributive mixer for mixing two liquids of different densities. It has insufficient power for dispersion.

US 2010/0300304 (Shimizu) discloses a hand tool for mixing small amounts of household food in the kitchen. It would not be suitable for shearing liquid metals. A further food mixer of this type is disclosed in WO 2007/042635 (Seb S.A.).

Current mechanical or electromagnetic stirring for treating liquid metals causes turbulence near the liquid surface which is harmful for most casting processes. Therefore, the stirring speed must be limited in order to achieve a relatively stable liquid surface, and consequently both effectiveness and efficiency of liquid metal treatment are compromised.

It would be advantageous, therefore, to provide a method and apparatus that can be readily applicable to existing casting processes and can provide intensive melt shearing while avoiding entrapment of gas and other contaminants from the melt surface.

The principal object of the present invention is to provide an apparatus and method for providing treated/conditioned liquid metal as feedstock for further solidification processing of metallic materials, particulate reinforced metal matrix composites (MMCs) and immiscible alloys.

Another object of the present invention is to provide an apparatus and method that can homogenise chemical compositions, disperse and distribute gas, liquid and solid phases in liquid metals or metal matrix composites (MMCs).

Still another object of the present invention is to enhance the kinetic conditions for chemical reactions and phase transformations involving at least one liquid phase.

Another object of the present invention is to provide an apparatus and method for producing high quality metallic materials or metal matrix composites (MMCs) with refined microstructure and reduced cast defects.

Yet another object of the present invention is to provide a means for dispersive mixing under high shear rate and distributive mixing with macroscopic flow in the entire volume of liquid metal without causing serious turbulence near the liquid surface.

These and other objects and advantages of the present invention will be more fully understood and appreciated with reference to the following descriptions, embodiments and examples.

SUMMARY OF THE INVENTION

The present invention provides an apparatus and method for intensive shearing of liquid metals to provide conditioned liquid metals suitable for solidification processing with a variety of casting processes.

In a first aspect of the present invention, there is provided a device for shearing liquid metals comprising:

- a stator in the form of a first hollow cylinder having an open end to allow liquid metal to enter the cylinder and at least one opening in the cylinder wall to allow liquid metal to exit the cylinder,
- a rotor comprising a shaft having at least one rotatable element thereon, the shaft being substantially parallel to the longitudinal axis of the cylinder and the rotatable element being disposed within the cylinder and arranged to rotate about said axis when driven by a motor,
- wherein the minimum gap between the rotatable element and the internal wall of the cylinder is from 10 μm to 10 mm, and wherein the device is formed from material or materials with a melting point of not less than 200° C., preferably not less than 600° C., and most preferably not less than 1000° C.

The relatively high melting points of the components of the device make it suitable for use in the high temperature environment of liquid metal processing.

The apparatus (the high shear device) for intensive shearing of liquid metals preferably comprises:

- a stator, the said stator is a hollow cylinder with at least one opening in the stator wall;
- a rotor, the said rotor has at least one blade and rotates at high speed inside the stator;
- a small gap between the said rotor and stator to ensure high shear rate;
- a housing, the said housing integrates the said stator, the said rotor and a rotor shaft for a rotor/stator assembly;
- a motor, the said motor set on a platform is connected to the said rotor shaft to drive the rotor;
- a bush, the said bush can be fixed on the said housing or on the said rotor shaft.

In one embodiment, the high shear device comprises:

- a stator, the said stator is a hollow cylinder fixed on the said housing and has at least one opening in its wall, and the preferred said openings are round holes with a diameter of 0.5 mm to 10 mm;
- a rotor, the said rotor inside the stator connected to the motor by a shaft has at least one blade, and the preferred said rotational speed of the said rotor is 1 RPM to 50000 RPM;
- a small enough gap between the said stator and rotor to ensure high enough shear rate for the intended purpose of liquid metal shearing, and the preferred said gap is 10 μm to 10 mm;
- a motor, the said motor set on a platform is connected to the shaft to drive the rotor;
- a housing, the said housing for holding a stator and supporting a rotor shaft is fixed on a platform to position the said high shear device;
- a bush, the said bush can be fixed on the said housing or on the said rotor shaft.

The said rotors and stators can be assembled in such a way that the apparatus becomes a multistage high shear pump to provide conditioned liquid metals batch wise or continuously to the casting processes of concern.

Thus, in an alternative embodiment, said apparatus is a high shear pump for providing treated/conditioned liquid metals as a feedstock to either continuous or shape casting processes, the said high shear pump comprises:

- at least two sets of the rotor/stator assemblies, the said rotor/stator assemblies can be arranged either concentrically or vertically to form a multistage high shear device;
- a small enough gap between the said stator and rotor in the said rotor/stator assemblies to ensure high enough shear rate for the intended purpose of liquid metal treatment. The preferred said gap is 10 μm to 10 mm, the preferred openings in the stator (or rotor) are round holes with a diameter of 0.5 mm to 10 mm, and the preferred said rotational speed of the said rotor is 1 RPM to 50000 RPM.
- a pump chamber, the said pump chamber houses the multistage rotor/stator assemblies;
- blocking plates to separate high shear zones and accumulating zones inside the said pump housing;
- a motor, the said motor set on the platform is connected to the shaft to drive the rotor;
- bushes, the said bushes can be fixed on the said pump housing or on the said rotor shaft;
- an inlet, the said inlet allows liquid metal to flow into the pump chamber;
- an outlet tube, the said outlet tube allows the conditioned melt to be supplied to the casting machine.

During operation, the motor passes the power to the rotor via the rotor shaft and drives the rotor to rotate inside the stator, and the liquid metals are intensively sheared in the gap between the said rotor and the said stator and also in the said openings of the said stator.

The method is intensively shearing of liquid metals either batch wise or continuously by using the said high shear device or the said high shear pump or the like without changing its spirit. The method also includes, but is not limited to, degassing of liquid metals, preparing semi-solid slurries, preparing metal matrix composites, mixing immiscible metallic liquids, providing conditioned liquid metals for further solidification processing with existing casting processes.

The functions of the apparatus and methods in a variety of forms according to this invention include, but are not limited to, the following:

The said high shear device and the said high shear pump can disperse effectively and distribute uniformly solid particles, liquid droplets and gas bubbles in the liquid metals.

The said high shear device and the said high shear pump can reduce the size of solid particles, liquid droplets or gas bubbles in the liquid metals.

The said high shear device and the said high shear pump can improve the homogenisation of chemical composition and temperature field in the liquid metals.

The said high shear device and the said high shear pump can provide physical grain refining to metals and alloys by activating both endogenous and exogenous solid particles in the liquid metals, resulting in a significant grain refinement of the metallic materials.

The said high shear device and the said high shear pump can enhance the kinetic conditions for chemical reactions and phase transformations involving at least one liquid phase.

The applications of this invention are summarised below:

(1) The said high shear device and the said high shear pump can be used to provide conditioned liquid metal with low gas content, well dispersed oxide films and other inclusions, uniform temperature and homogeneous chemical composition, as a feedstock suitable for solidification processing with a variety of casting processes.

(2) The said high shear device and the said high shear pump can be used as an attachment to existing casting processes for grain refinement, for facilitating the casting process and for improving the quality of the cast products. For instance, but not limited to, the high shear device can be directly implemented into the direct chill casting and twin roll casting processes for promoting equiaxed solidification and into shape casting processes as a dosing pump to provide directly conditioned liquid metal.

(3) The said high shear device and the said high shear pump can be used to disperse and distribute gas, liquid and discrete solid phases into a liquid matrix, such as degassing with high efficiency, mixing immiscible metallic liquids to produce finely dispersed microstructures, producing metal matrix composites with well dispersed and uniformly distributed fine solid particles, and enhancing chemical reactions between hetero phases.

BRIEF DESCRIPTION OF THE DRAWINGS AND FIGURES

A number of preferred embodiments of the present invention will now be described with reference to the accompanying drawings, in which.

Figure 10:
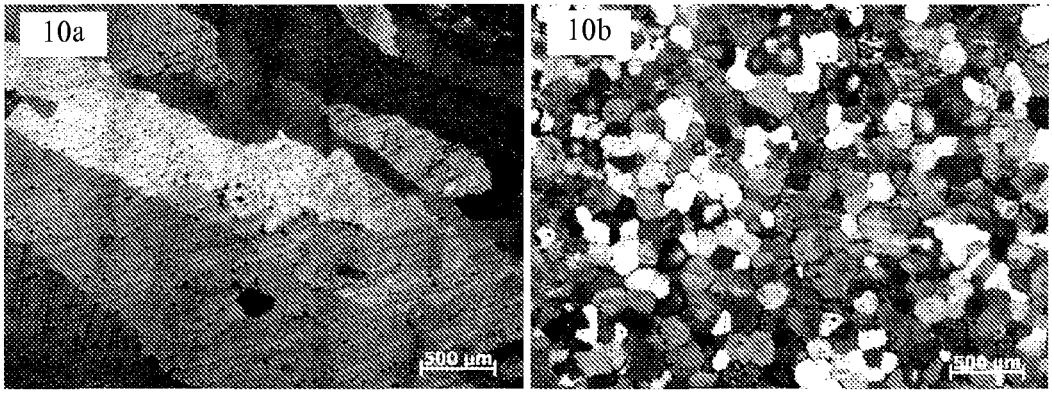

FIG. 10*a* shows the microstructure of AZ31 magnesium alloy prepared by a conventional DC casting process.

FIG. 10*b* shows the microstructure of AZ31 magnesium alloy prepared by a DC casting process with intensive melt shearing using the high shear device according to this invention.

Figure 11:
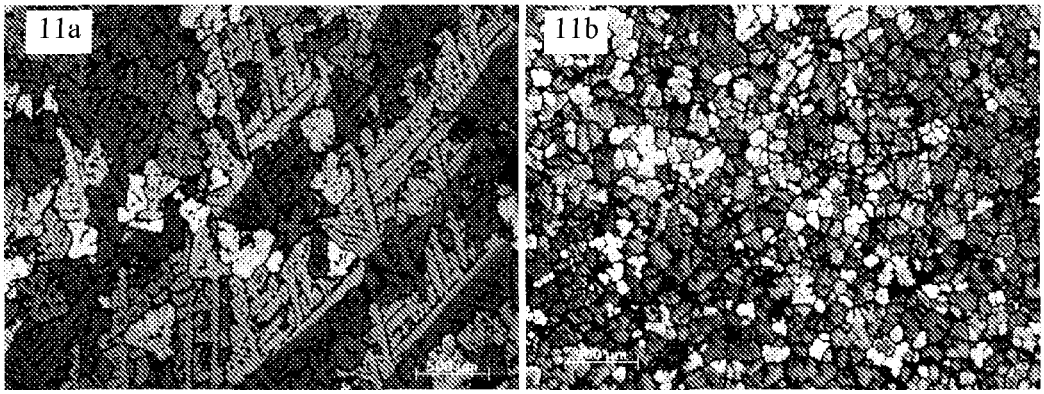

FIG. 11*a* shows the microstructure of AA7075 aluminium alloy prepared by a conventional DC casting process.

FIG. 11*b* shows the microstructure of AA7075 aluminium alloy prepared by a DC casting process with intensive melt shearing using the high shear device according to this invention.

Figure 12:
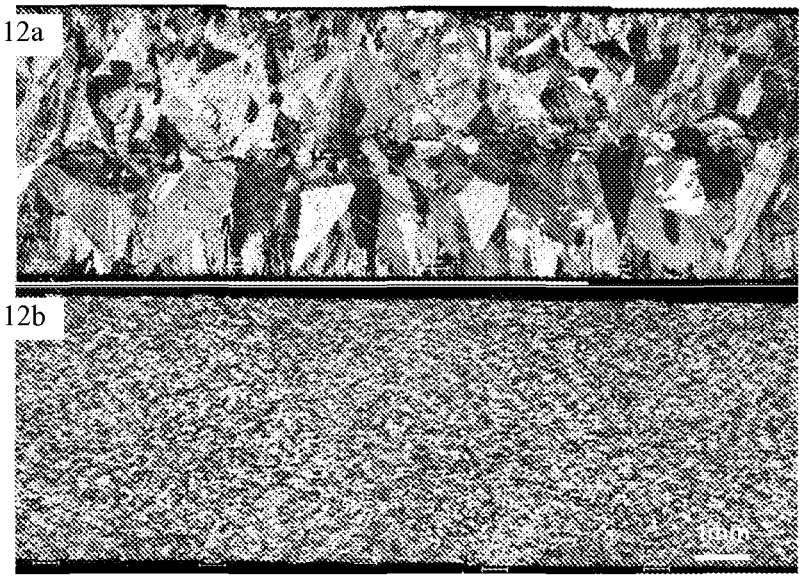

FIG. 12*a* shows the microstructure of a 5 mm thick AZ31 magnesium alloy strip prepared by conventional twin roll casting process.

FIG. 12*b* shows the microstructure of a 5 mm thick AZ31 magnesium alloy strip prepared by integration of the conventional twin roll casting process with the multi stage high shear pump according to this invention.

DETAILED DESCRIPTION OF THE INVENTION

The present invention provides a high shear device, a high shear pump and methods for treating/conditioning liquid metals by intensive melt shearing. The said high shear device and high shear pump can be used to provide conditioned liquid metals for solidification processing using a variety of casting processes. The said high shear device and high shear pump can also be directly integrated into specific casting processes for facilitating the casting processes and improving the quality of the cast product. Referring now to the drawings and micrographs, the present invention is described in detail in the following section.

Figure 1:
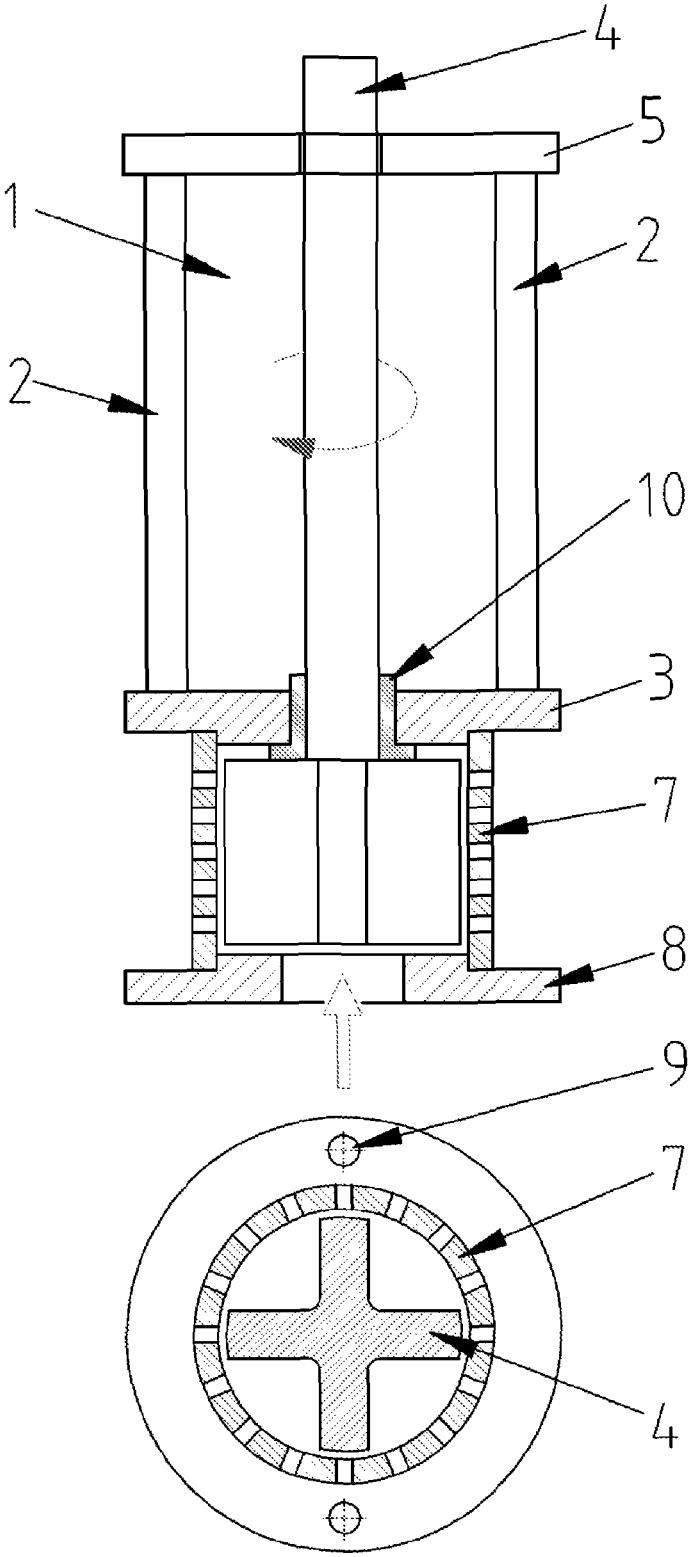
FIG. 1 is a schematic illustration of a high shear device as one of the embodiments according to the present invention.

Referring to FIG. 1, an embodiment of the said high shear device (1) mainly comprises a rotor (4) and a stator (7). The said rotor (4) comprising a rotor shaft and rotor blades is driven by a motor (not shown). A housing comprising housing plates (3, 5, 8) and tie bars (2) is fixed to a platform (not shown). The stator (7) is fixed by housing plates (3, 8) using at least two fixing bolts (9). There is a bush (10) fixed on the housing plate (3) to locate the rotor shaft and to provide sealing.

The said rotor (4) comprises at least one blade to drive the said liquid metal during operation. In this embodiment, according to the present invention, the preferred number of blades is four. The said blade can be parallel to or at an angle with the axis of the said rotor. The shapes of the said blade can be a cylinder, square column, prism, and any other geometric bodies either regular or irregular, as long as they can be manufactured and assembled practically. The shape of the individual blades can be different from one another, and the surface of one blade can be flat or curved or combined by different geometric surfaces. Different blades may be used for the same rotor. The distribution of the blades around the rotor shaft does not need to be symmetrical.

The said stator (7) is a hollow cylinder with at least one opening on its wall. The shapes of the openings on the said stator wall can be round holes, square holes, slots or the like, as long as the said liquid metal is sheared efficiently and practically. The preferred openings are round holes of a suitable size.

During operation, the said rotor (4) is driven by a motor (not shown) through the said shaft. The said rotor blades displace outwards the liquid metal inside the shear chamber under centrifugal force, creating a negative pressure inside the said shearing chamber. The said negative pressure sucks the liquid metal into the shear chamber through the opening on the said bottom housing plate (8). There is intensive melt shearing both in the gap between the rotor and the stator and in the openings in the stator wall. The intensity of shearing is a function of the gap between the said rotor and the said stator, the size of the said openings on the said stator, and the rotational speed of the said rotor. A smaller gap, smaller openings and faster rotation speed of the rotor are favourable to higher intensity of shear. The preferred said gap is 10 μm to 10 mm, the preferred said openings are round holes with a diameter of 0.5 mm to 10 mm, and the preferred said rotational speed of the said rotor is 1 RPM to 50000 RPM.

Figure 2:
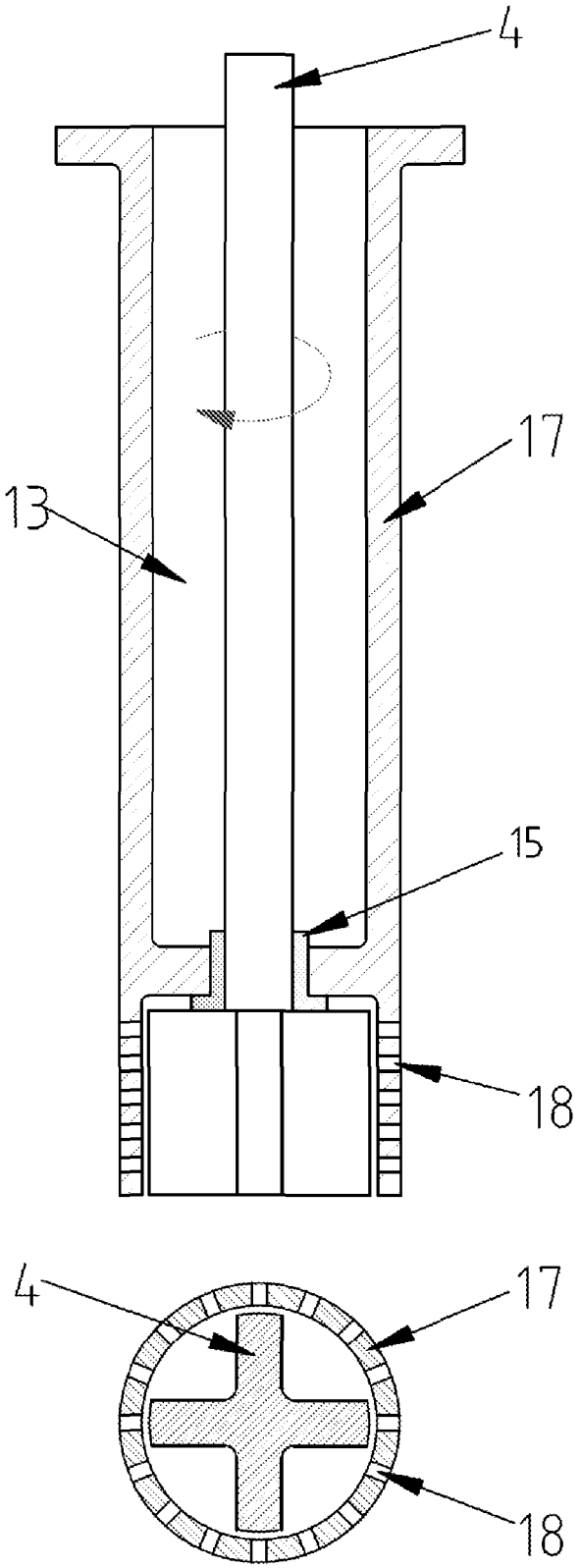
FIG. 2 is a schematic illustration of another high shear device as one of the embodiments according to the present invention.

Referring to FIG. 2, another embodiment of the said high shear device (13) mainly comprises a one-piece rotor (4), a tubular stator (17) having openings (18) on its wall, and a bush (15). The said embodiment is similar to the previous embodiment shown in FIG. 1, but is easier for construction of components using ceramic based materials, and is more suitable for corrosive liquid metals (such as aluminium) and high melting temperature alloys. The working principle of this embodiment referring to FIG. 2 is exactly the same as that of the previous embodiment referring to FIG. 1.

Figure 3:
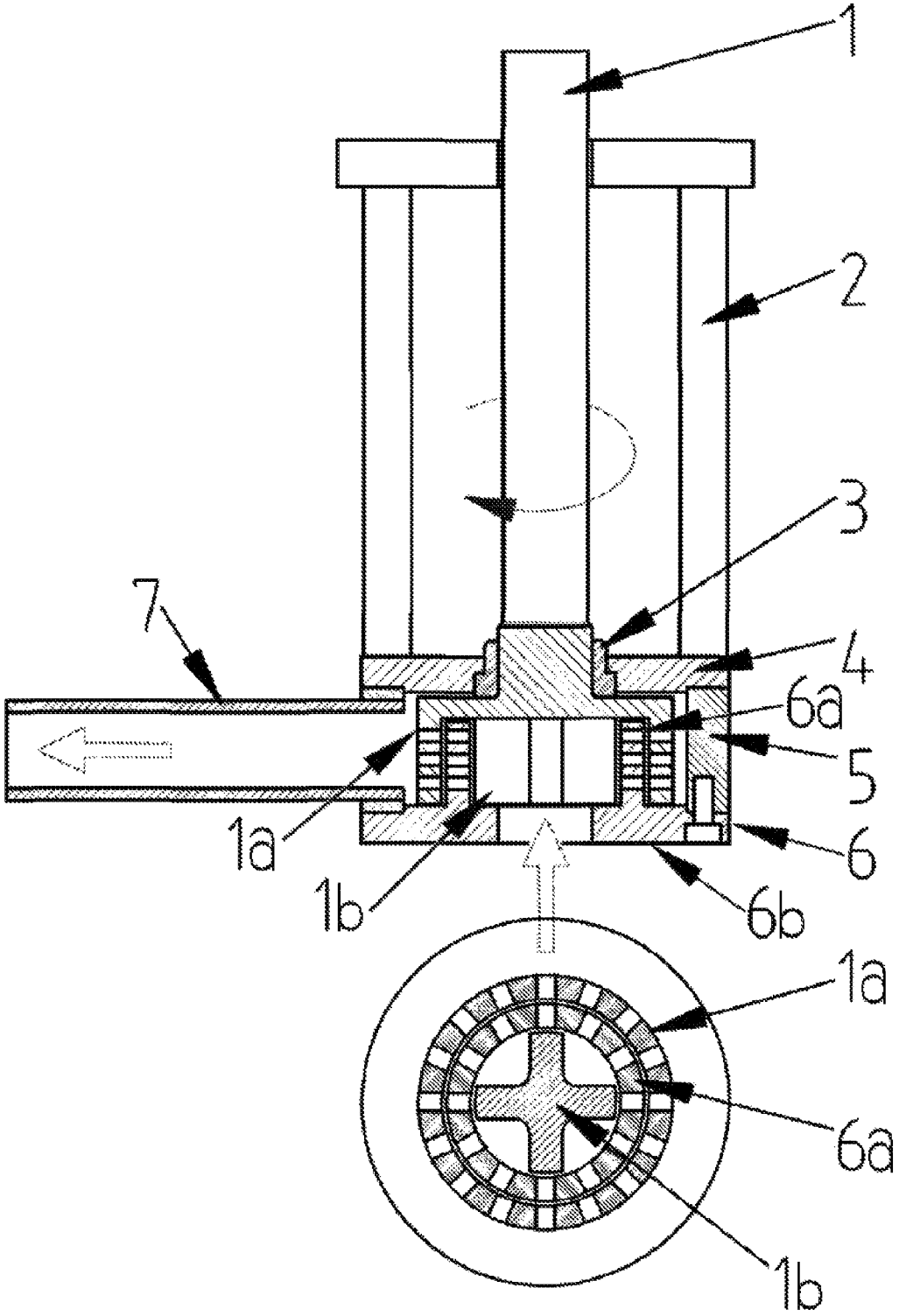
FIG. 3 is a schematic illustration of an embodiment of the said multistage high shear pump with concentric rotor/stator arrangement for providing continuously treated/conditioned liquid metal according to the present invention.

FIG. 3 is a schematic diagram showing an embodiment of the multistage high shear pump where the rotors and stators are arranged concentrically one in another. Referring to FIG. 3, the multistage high shear pump comprises mainly a rotor (1), a stator (6), a housing ring (5), an upper housing plate (4), a bush (3) and an outlet tube (7). The rotor (1) is a one-piece component, comprising a rotor shaft, a first rotatable element (here defined as multiple rotor blades (1*b*)), and a second rotatable element (here defined as a rotor ring (1*a*) with openings). The openings can be round holes, square holes, rectangular slots or any other geometric shape. The stator (6) is a cylindrical stator ring (6*a*) with openings in the internal wall of the cylinder (6*b*) allowing liquid metal to exit, with the stator ring (6*a*) being attached to a stator plate (6*c*) with an opening at the centre as an inlet for the liquid metal. The rotor/stator assembly is housed in a pump chamber comprising the stator plate (6*c*), the upper housing plate (4), the housing ring (5) and the bush (3). The rotor/stator assembly, the pump housing and the rotor shaft are integrated via the fixing tie bar (2).

In FIG. 3, only one stator ring (6*a*) and one rotor ring (1*a*) are shown for simplicity. In practice, more than one set of rotor/stator rings can be used to enhance the efficiency of shearing depending on the specific purpose of the intended melt treatment.

During operation, the rotor (1) is driven by a motor (not shown), and the rotation of the rotor blades (1*b*) will create a negative pressure in the pump chamber. The negative pressure in turn sucks liquid metal into the pump chamber through the opening on the stator plate (6*c*). Under centrifugal force created by the rotor blades (1*b*), the liquid metal is forced to flow outwards and eventually pumped out through the outlet tube (7). The relative motion between the rotor blades (1*b*), the stator ring(s) (6*a*) and the rotor ring(s) (1*a*) will subject the liquid metal to extremely high shear and turbulent flow in the pump chamber. The shear rate is a function of the rotation speed of the rotor, the gap between the stator rings (6*a*) and rotor rings (1*a*) and the size of the openings on both the stator and rotor rings. The pumping rate can be controlled by varying the rotation speed of the rotor (1) and the gap between the tip of the rotor blades (1*b*) and the stator ring (6*a*). An optimised combination of the parameters will provide the desired pumping rate. The preferred gap is 10 μm to 10 mm, the preferred openings are round holes with a diameter of 0.5 mm to 10 mm, and the preferred rotational speed of the rotor is 1 RPM to 50000 RPM.

Figure 4:
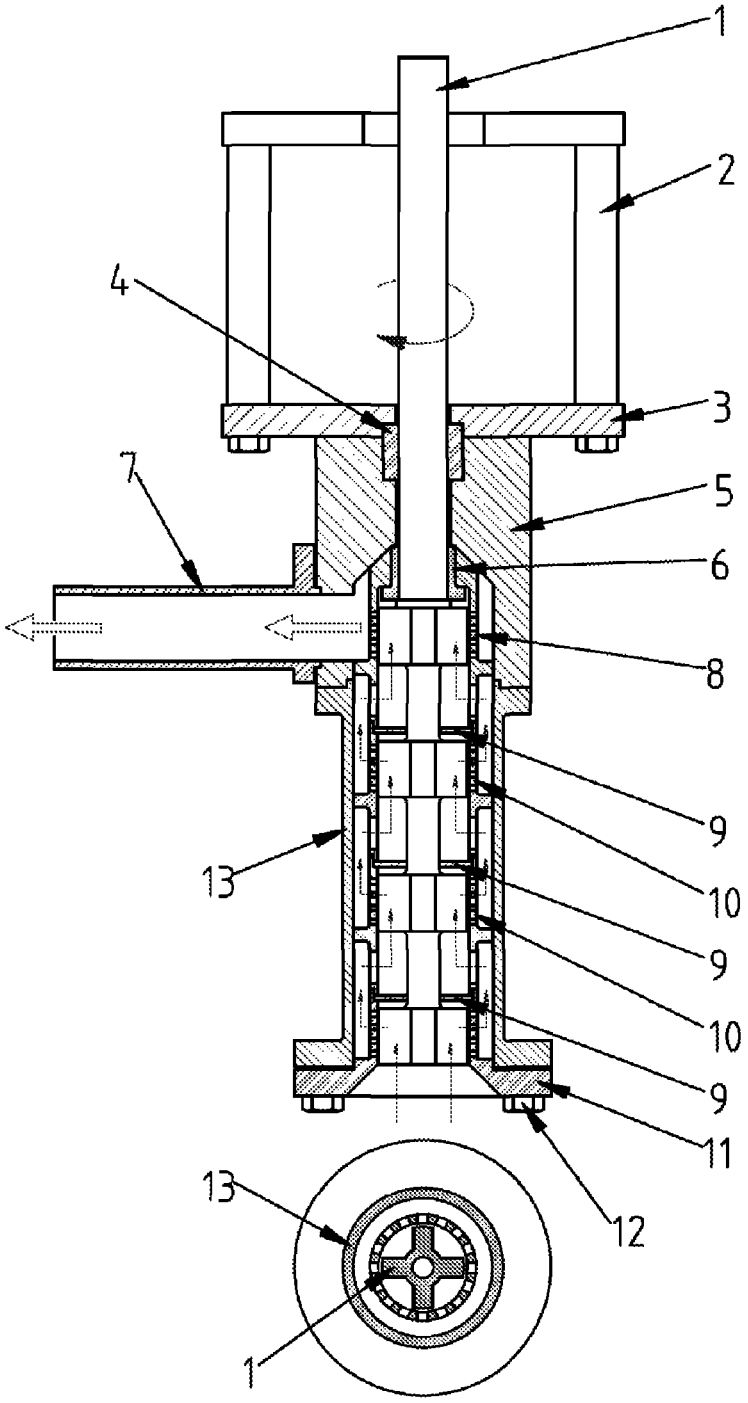
FIG. 4 is a schematic illustration of another embodiment of the said multistage high shear pump with vertical rotor/stator arrangement for providing continuously treated/conditioned liquid metal according to the present invention.

FIG. 4 is a schematic diagram showing another embodiment of the said multistage high shear pump, wherein the said rotors and stators are arranged vertically. Referring to FIG. 4, the said multistage high shear pump comprises 4 sets of rotors (1) and stators (8, 10, 11), which are assembled vertically in a tubular pump chamber (13). The said rotor can be either made in one-piece by integrating the rotor shaft and sets of rotor blades into one component (as shown) or in the form of an assembly of individual rotor blades attached to a rotor shaft. The stator with openings in the stator wall comprises an inlet stator (11), two intermediate stators (10) and an outlet stator 8. The said stators can be made from either the same design or different designs. There is a blocking plate (9) between the stators to divide the pumping chamber into individual high shear zones. The said high shear zones are separated by melt accumulating zones. The said rotor/stator assembly is fixed in the tubular pump chamber (13) through the rotor housing (5), bushes (4) and (6), tie bar (2) and fixing bolt (12).

In FIG. 4, four sets of rotor/stator assemblies are shown for the purpose of illustration. In practice, any number of rotor/stator sets can be used to suit the specific applications depending on the specific purpose of intended melt shearing.

During operation, the rotor (1) is driven by a motor (not shown), and the rotation of the rotor blades inside the inlet stator will create a negative pressure in the pump chamber, which in turn sucks liquid metal into the inlet stator through the opening at the bottom of the inlet stator. Under centrifugal force created by the rotor blades, liquid metal is forced to flow outwards and eventually collected in the accumulation zone above the inlet stator. This process is repeated in all of the available high shear zones before conditioned liquid metal is eventually pumped out through the outlet tube (7). The working principle is the same as the said embodiment shown in FIG. 3.

The materials selections for construction of the apparatus through the said embodiments shown in FIGS. 1-4 or any other embodiments of the same or similar spirit of this invention have to satisfy the following requirements:

- they should be of high strength and high durability at the application temperatures;
- they have to be corrosion resistant to withstand the corrosive nature of the liquid metals;
- they have to be feasible to manufacture using available manufacturing techniques;
- they have to be readily available to save cost.

Ceramics, graphite, steels, high temperature alloys and any other materials could be used for manufacturing the high shear devices as long as they have enough strength and chemical stability at the processing temperature. For example, nickel-free high temperature steels are the preferred materials for construction of the said high shear devices for treating/conditioning of liquid magnesium alloys. Graphite, molybdenum coated with $MoSi_2$ and ceramics are preferred materials for construction of the said high shear devices for treating/conditioning of aluminium alloys. Suitable ceramic materials include, but are not limited to, nitrides, silicides, oxides, carbides, sialon and other mixed ceramics. Particularly preferred ceramics include silicon carbide, aluminium oxides, boron nitride, silicon nitride and sialon. To be noted, graphite is one of the suitable materials for bushes in all the embodiments.

Figure 5:
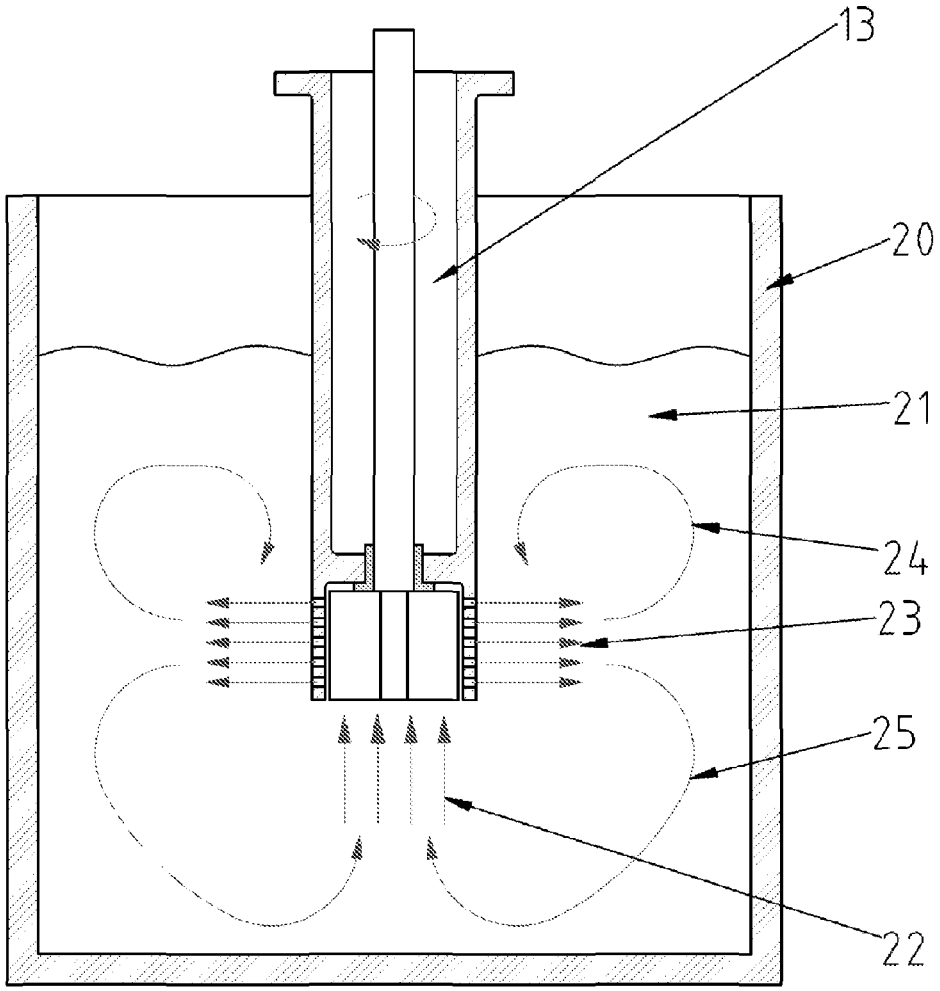
FIG. 5 is a schematic illustration of a liquid metal conditioning process using the high shear device shown in FIG. 2.

FIG. 5 is a schematic diagram showing an embodiment for treating/conditioning liquid metals according to the present invention. The intensive shearing apparatus (13), referring to FIG. 5, is fixed on an adjustable platform (not shown) and the rotor shaft is driven by a motor (not shown). The position of the said intensive shearing apparatus (13) is controlled, partially immersed in the liquid metal (21) contained in a crucible (20) by adjusting the platform. The crucible (20) can be heated by a variety of means to keep the melt at a desirable temperature.

During operation, the liquid metal (22) is sucked into the high shear chamber from the bottom of the intensive shearing apparatus (13), and the said liquid metal is subjected to intensive shearing. The sheared liquid metal (23) drives the liquid metal inside the crucible to form a macroscopic flow pattern as shown by (24) and (25). The said macroscopic flow will deliver the liquid metal to the high shear chamber, wherein all the liquid metal in the crucible is subjected to repeated high shear treatment. In addition the macroscopic flow also promotes spacial uniformity of both melt temperature and chemical composition.

The said intensive melt shearing provided by the said high shear device disperses the oxide clusters, oxide films and any other metallic or non-metallic inclusions present in the liquid metals. The said macroscopic flow will distribute all the dispersed particles uniformly throughout the entire melt in the said crucible. It should be pointed out that the said macroscopic flow in the crucible will be weak near the melt surface, and consequently, the said macro melt flow will maintain a relatively undisturbed melt surface, avoiding the possible entrapment of gas, dross or any other potential contaminants. This makes the conditioned liquid metals particularly suitable for manufacturing high quality castings.

The other main function of the said high shear device is to disperse exogenous solid particles into liquid metal. The said exogenous solid particles can be grain refiner particles, ceramic particles for metal matrix composites (MMCs) or nano particles for production of nano metal matrix composites (NMMCs). The said high shear device will disperse the solid particle agglomerates, distribute the dispersed solid particles uniformly in the liquid metal, and force the solid particles to be wetted by the liquid metal.

The apparatus and method referring to FIG. 5, can be used to treat liquid metals either above the alloy liquidus to condition liquid metal or below the alloy liquidus to make semi-solid slurry.

When treating liquid metals above liquidus, the said apparatus and method can increase potential nucleation sites by dispersing oxide films and/or clusters into individual particles, improving the wettability and spacial distribution in the liquid metal. This is very helpful for grain refinement without addition of any chemical grain refiners. This is referred to as physical grain refinement.

When treating the metals below their liquidus, the said apparatus and method can provide semisolid slurry with solid particles of fine size and a narrow size distribution. In addition, the said apparatus and method can provide high quality semi-solid slurry in large quantities.

The said conditioned liquid metal, treated either above or below the alloy liquidus, can be supplied batch wise or continuously to a specific casting process, the said casting process includes high pressure die casting, low pressure die casting, gravity die casting, sand casting, investment casting, direct chill casting, twin roll casting, and any other casting process which requires liquid or semi-solid metal as a feedstock.

Figure 6:
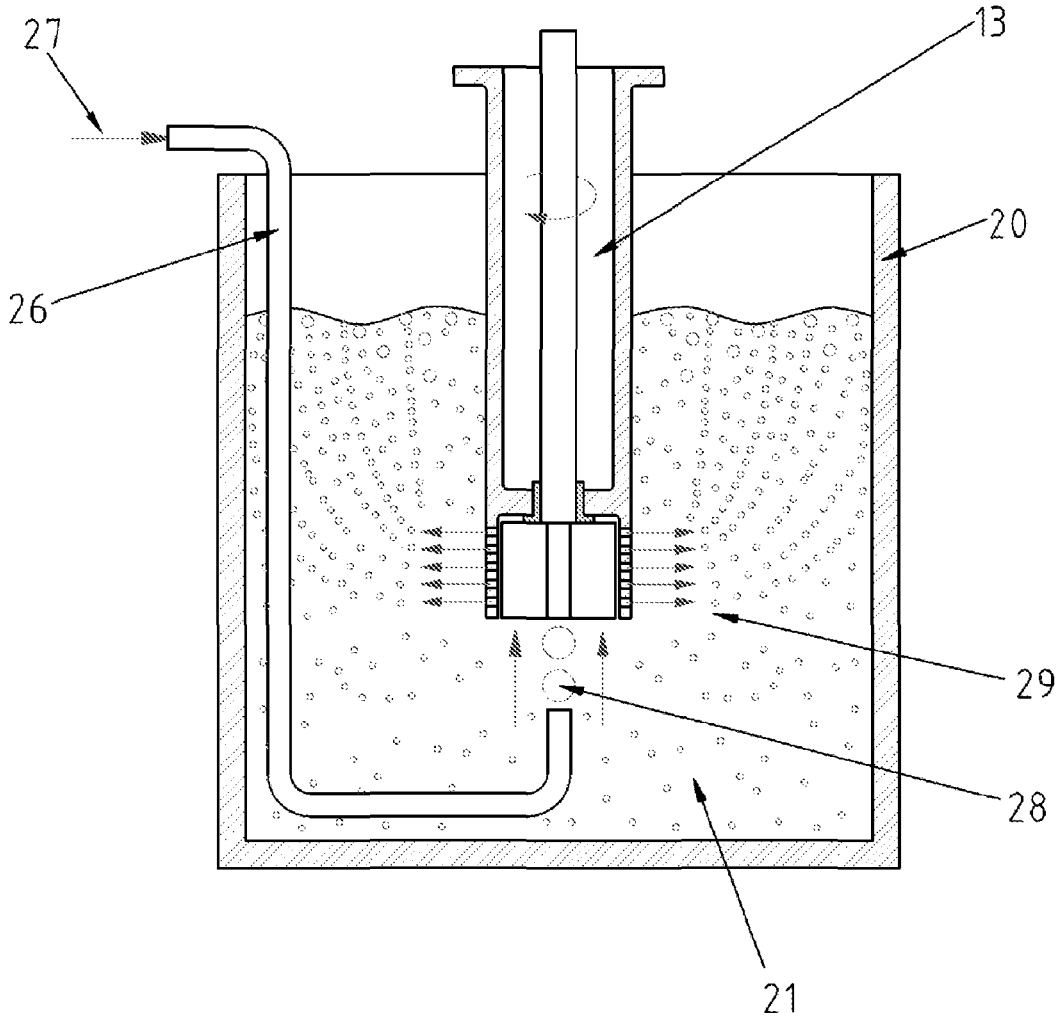
FIG. 6 is a schematic illustration of a liquid metal degassing process using the high shear device shown in FIG. 2.

FIG. 6 shows a schematic diagram of an embodiment of a liquid metal degassing process using the said high shear device according to this invention. The high shear device (13), referring to FIG. 6, is fixed on an adjustable platform (not shown) to position the said high shear device in the liquid metal. The position of the said high shear device (13) is controlled, partially immersed in the liquid metal (21) contained in a crucible (20) by adjusting the platform. The crucible (20) can be heated by a variety of heating means to maintain the melt at a desirable temperature. A tube 26 is set in the crucible (20) and one end of the tube is located beneath the high shear device (13). For the purpose of degassing of liquid metal, inert gas (27), such as Ar, $N_2$ or the like, is introduced into the liquid metal through the tube (26).

During operation, the liquid metal and the introduced inert gas bubbles 28 are sucked into the high shear chamber from the bottom of the high shear device (13), and forced out at high speed through the openings in the stator wall, which generates intensive melt shearing both in the high shear chamber and macro melt flows as shown in FIG. 5. During this process, the said intensive melt shearing can disperse the large inert gas bubbles (28) into much smaller gas bubbles (29). The said macro liquid flow can distribute the fine bubbles uniformly throughout the liquid metal in the crucible (20), creating significantly increased gas/liquid interfacial area. The dissolved gas in the liquid metal will diffuse to the inert gas bubbles (29) due to the much lower partial pressure in the inert gas than in the liquid metal. Under the buoyancy force and with the assistance of the macro melt flow, inert bubbles (29) containing the dissolved gas will escape from the melt surface, resulting in significantly reduced gas contents in the liquid metal.

When degassing using the embodiment in FIG. 6, the size of the inert bubbles in the liquid metal can be controlled by adjusting the gap between the rotor and the stator, the size and shape of openings in the stator wall, and the rotational speed of the rotor shaft in the said high shear device. The preferred said gap is 10 μm to 10 mm, the preferred said openings are round holes with a diameter of 0.5 mm to 10 mm, and the preferred said rotational speed of the said rotor is 1 RPM to 50000 RPM.

The said embodiment referring to FIG. 6 can also be used to prepare metal matrix composites (MMCs) by changing the input inert gas (27) to ceramic powders such as silicon carbide, aluminium oxide or the like. The said intensive melt shearing can improve the uniformity and the wettability of the particles, which is very important for preparing high quality MMC materials.

The said embodiment referring to FIG. 6 can also be used to prepare in situ metal matrix composites (MMCs) by changing the input inert gas (27) to a reactive gas to form reinforcing particles in situ. One example is introducing oxygen to liquid aluminium alloy to prepare alumina particle reinforced aluminium MMCs.

The said embodiment referring to FIG. 6 can also be used to mix immiscible metals by changing the input inert gas (27) to a liquid metal which is immiscible with the liquid metal (21) in the crucible (20). The said intensive melt shearing can disperse and distribute the immiscible metallic liquids uniformly.

The said embodiment referring to FIG. 6 can also be modified without changing the spirit of this invention by using a hollow rotor shaft to introduce the inert gas, the ceramic particles, the immiscible liquid metals or the like to the liquid metal (21) for the purpose of degassing, preparing MMCs, mixing immiscible metallic liquids or the like.

Figure 7:
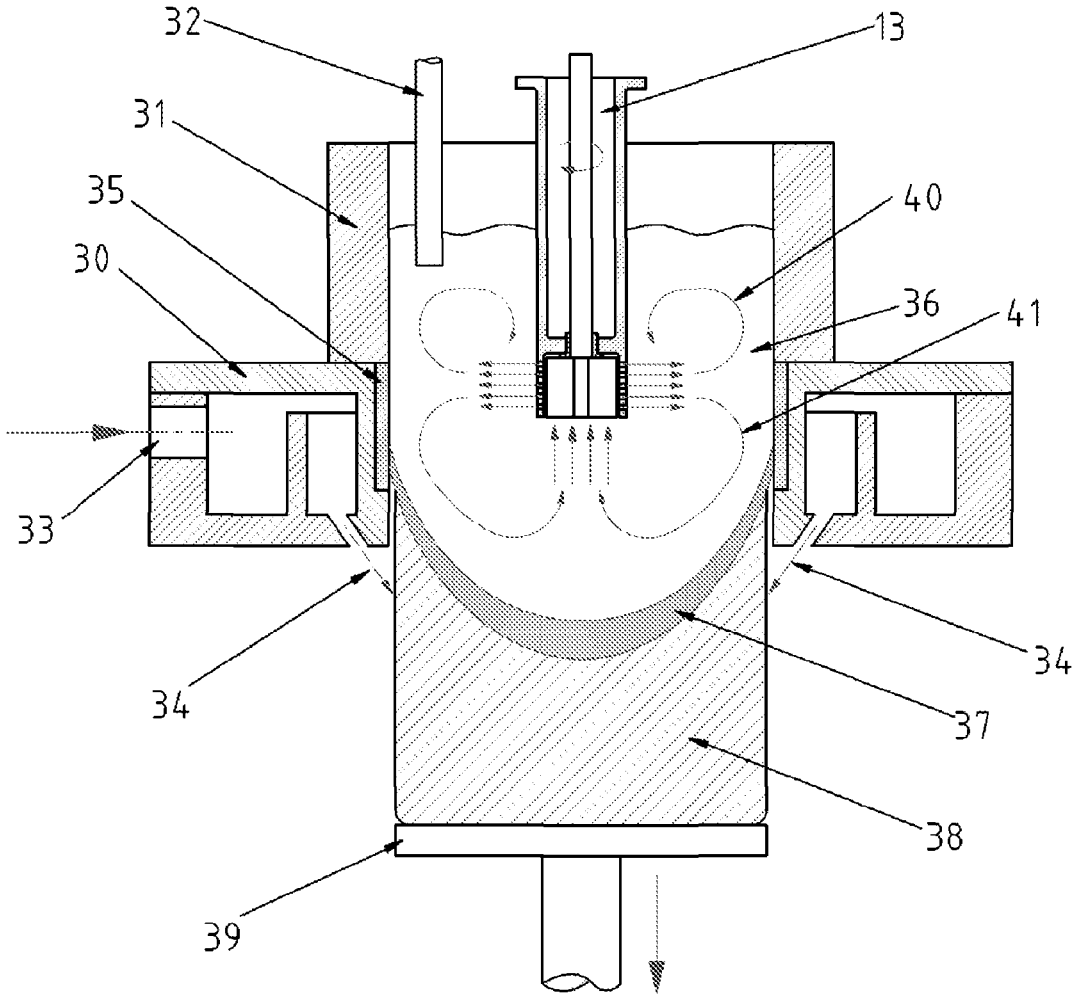
FIG. 7 is a schematic illustration of a direct chill (DC) casting process by integrating the conventional DC casting process with the high shear device shown in FIG. 2.

FIG. 7 shows a schematic diagram of an embodiment of direct integration of a conventional direct chill (DC) casting process with the high shear device according to the present invention, forming a high shear DC casting process. The high shear device (13), referring to FIG. 7, is fixed on an adjustable platform (not shown) for positioning. The said high shear device is submerged into the sump of a conventional DC caster with a hot-top (31) and a DC mould (30) mounted with a graphite ring (35). The preferred location of the bottom of the said high shear device (13) is 0-300 mm above the mushy zone.

During DC casting, the liquid metal (36) is continuously supplied to the DC mould (30) through the feed tube (32) and continuously sheared by the high shear device (13). Liquid metal containing the rejected solute elements and the solid particles in the mushy zone (37) is sucked into the high shear device from the solidification front, subjected to intensive melt shearing and then forced out at high speed through the openings in the stator wall. The said intensively sheared melt generates a macroscopic flow pattern (40, 41) in the sump of the DC caster. The said macroscopic flow pattern will in turn cause the homogenisation of temperature and chemical composition in the liquid metal around the said high shear device. This creates a unique solidification condition in the sump of the DC caster, resulting in a cast ingot (38) with a fine and uniform microstructure, uniform chemical composition and reduced/eliminated cast defects.

The above said embodiments referring to FIGS. 5-7 are intended to illustrate specific applications of the said high shear device and high shear pump for liquid metal treatment, not intended as a limitation of the present invention. The following brief descriptions can be used as further illustrations to the present invention, particularly, the said high shear pump as a device for supplying conditioned liquid metal to a variety of casting processes.

A further embodiment of the present invention is the integration of the said high shear pump referring to FIGS. 3 and 4 in a melting furnace or a holding furnace to supply conditioned liquid metal to a continuous ingot casting machine for the production of high quality ingots. The said ingots containing well dispersed oxide particles have self grain refining power, and can be used as a feedstock for the casting house for high quality castings.

Yet another embodiment of the present invention is the integration of the said high shear pump referring to FIGS. 3 and 4 in a melting furnace or a holding furnace to supply conditioned liquid metal to a continuous (or semi-continuous) casting process. The said continuous process includes, but is not limited to, twin roll casting for thin strips, direct chill casting for ingots and slabs, up-casting for rods and any other continuous (or semi-continuous) casting process which requires liquid metal as a feedstock. The supply rate of the said conditioned melt can be controlled by varying the rotor speed and the design of the rotor/stator assembly.

Yet another embodiment of the present invention is the integration of the said high shear pump referring to FIGS. 3 and 4 in a melting furnace or a holding furnace to supply conditioned liquid metal to a shape casting process to produce shaped components. The said shape casting process includes, but is not limited to, high pressure die casting, low pressure die casting, gravity die casting, sand casting, investment casting and any other shape casting processes which requires liquid metal as a feedstock. The dosing of the said conditioned melt can be controlled by varying the rotor speed and the design of the rotor/stator assembly.

The following examples are used to illustrate the outcomes of implementing the high shear device and high shear pump according to the present invention, and are not intended as a limitation of the present invention.

EXAMPLE 1

AZ91D magnesium alloy was melted at 680° C. and was then conditioned at a temperature below its liquidus by intensive melt shearing with the method and apparatus referring to FIG. 3. The conditioned AZ91D semisolid slurry was fed into a standard cold chamber high pressure die casting machine to cast tensile test samples.

Figure 8:
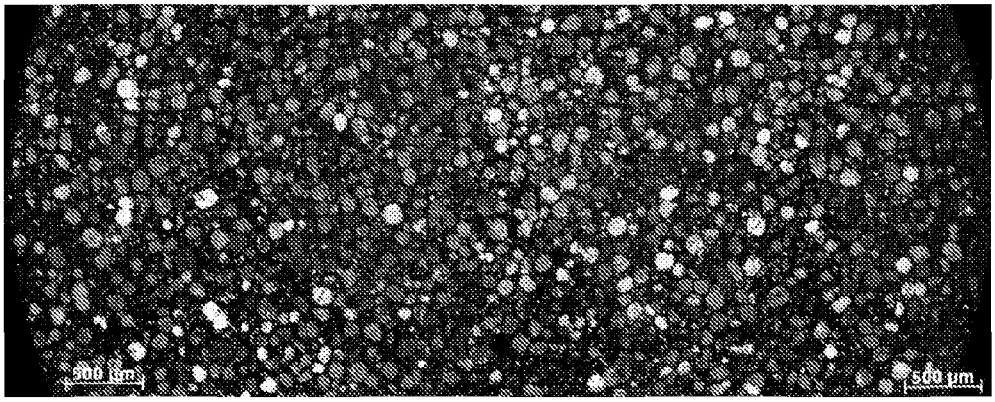
FIG. 8 shows the microstructure of AZ91D magnesium alloy prepared by semi-solid process using the high shear device according to this invention.

FIG. 8 shows the uniform and fine microstructure of the AZ91D sample prepared by semisolid processing according to this invention.

EXAMPLE 2

LM24 cast aluminium alloy and AA7075 wrought aluminium alloy were melted at 700° C. and then degassed with the method and apparatus embodied in FIG. 6 according to the present invention. The gas content in the liquid aluminium alloys was evaluated by the reduced pressure test (RPT) using the density index as an indicator of the gas content in the melt (the higher the density index, the higher the gas content). For the recycled LM24 alloy, after degassing with the method and apparatus of the embodiment shown in FIG. 6 for 1 minute the density index was decreased from 13.60% to 2.66%. For the fresh AA7075 alloy, the density index was decreased from 9.32% to 0.69%.

EXAMPLE 3

Figure 9:
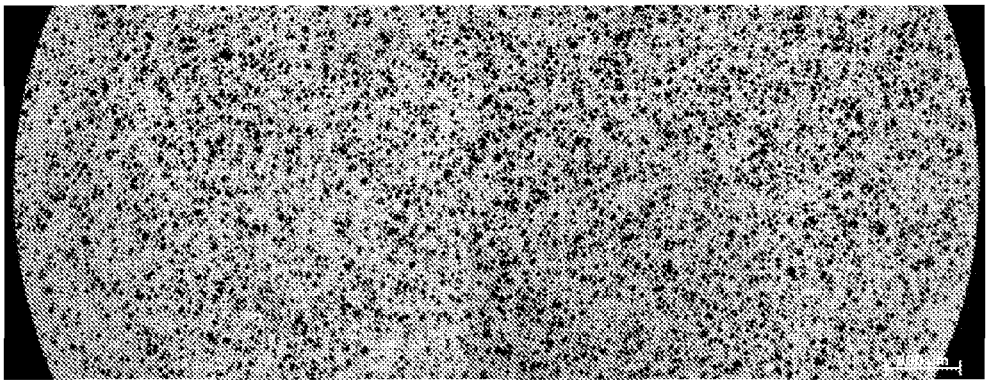
FIG. 9 shows the microstructure of AZ91D magnesium alloy based metal matrix composite prepared by intensive melt shearing using the high shear device according to this invention.

AZ91D magnesium alloy based MMC was prepared at 630° C. with intensive melt shearing according to the method and apparatus referring to FIG. 6 according to the present invention. The AZ91D magnesium alloy was melted at 650° C. Preheated silicon carbide particles were added to the melt through the feed tube (26) referring to FIG. 6 with the assistance of intensive melt shearing and then the melt with silicon carbide particles were intensively sheared for a further 5 minutes. The prepared Mg/SiC slurry was then fed into a standard cold chamber high pressure die casting machine to cast MMC samples. FIG. 9 shows the fine and uniform structure and the well distributed silicon carbide particles in a Mg matrix.

EXAMPLE 4

AZ31 magnesium alloy was melted at 680° C. The liquid metal without melt conditioning was cast at 670° C. by the conventional DC casting process to produce the result show in FIG. 10*a*. The same liquid metal was then cast using the embodiment of the present invention referring to FIG. 7 to produce the result shown in FIG. 10*b*. A comparison between FIGS. 10*a* and 10*b* shows that the high shear DC casting process (FIG. 7) can produce Mg-alloy ingot with fine and uniform microstructure without using any grain refiner addition.

EXAMPLE 5

AA7075 aluminium alloy was melted at 720° C. The liquid metal without melt conditioning was cast at 700° C. by the conventional DC casting process to produce the result show in FIG. 11*a*. The same liquid metal was then cast using the embodiment of the present invention referring to FIG. 7 to produce the result shown in FIG. 11*b*. A comparison between FIGS. 11*a* and 11*b* shows that the high shear DC casting process (FIG. 7) can produce Al-alloy ingot with fine and uniform microstructure without using any grain refiner addition.

EXAMPLE 6

AZ31 magnesium alloy was melted at 680° C. The liquid metal without melt conditioning was cast at 650° C. by the conventional twin roll casting process to produce the result show in FIG. 12*a*. The same liquid metal was then cast using the embodiment of integration of the high shear pump (referring to FIG. 4) and the conventional twin roll caster to produce the result shown in FIG. 12*b*. A comparison between FIGS. 12*a* and 12*b* shows that the high shear twin roll casting process can produce Mg-alloy strip with fine and uniform microstructure throughout the entire thickness with eliminated/reduced centreline segregation.

The invention claimed is:

1. A device for shearing liquid metals comprising:

a stator in the form of a hollow first cylinder having an open end configured to allow liquid metal to enter the cylinder and at least one opening in an internal wall of the cylinder configured to allow liquid metal to exit the first cylinder, a rotor comprising a shaft oriented substantially parallel to the longitudinal axis of the first cylinder, the shaft including first and second rotatable elements thereon, the first rotatable element being disposed within the first cylinder and the second rotatable element being disposed outside the first cylinder, the rotatable elements being arranged to rotate about said axis when driven by a motor, wherein a minimum gap between the first rotatable element and the internal wall of the cylinder is from 10 μm to 10 mm, whereby liquid metal is sheared in the gap, and wherein the device is formed from material or materials with a melting point of not less than 600° C.

2. A device as claimed in claim 1, wherein the opening is a round hole with a diameter from 0.5 mm to 10 mm.

3. A device as claimed in claim 1, additionally comprising a motor configured to rotate the rotatable elements at a speed from 1 rpm to 50,000 rpm.

4. A device as claimed in claim 1, wherein the components of the device are independently formed from graphite, a ceramic, steel, or molybdenum.

5. A device as claimed in claim 1, additionally comprising at least one additional stator in the form of a hollow cylinder surrounding the second rotatable element.

6. A device as claimed in claim 1, wherein the second rotatable element is spaced apart from the first along the length of the shaft.

7. A device as claimed in claim 6, additionally comprising a second stator for the second rotatable element, said second stator being in the form of a hollow second cylinder having at least one opening therein to allow liquid metal from the first cylinder to enter the second cylinder and having at least one opening in a wall of the second cylinder to allow liquid metal to exit the second cylinder.

8. A device as claimed in claim 6, additionally comprising a chamber in communication with the first cylinder and the second cylinder, whereby in use liquid metal from the first cylinder is accumulate in the chamber before entering the second cylinder.

9. A device as claimed in claim 8, wherein the first and second cylinders are disposed in a housing, wherein the chamber is formed between external walls of the cylinders and an internal wall of the housing.

10. A device as claimed in claim 5, having sets of additional rotors and stators in series, whereby in use the liquid metal passes from the first set to the last set.

11. A method for providing treated/conditioned liquid metals including the step of shearing metal between the rotor and the stator of the device of claim 1.

12. The method of claim 11 in which the shearing is carried out either above the liquidus of the metal to condition the metal for grain refinement or below the liquidus of the metal to make semi-solid slurry.

13. The method of claim 11 further including the step of supplying the sheared metal as feedstock for an at least partially continuous casting process.

14. The method of claim 11 further including the step of supplying the sheared metal as feedstock for a shape casting process.

15. A method for degassing liquid metal by introducing inert gas to the liquid metal, and shearing the liquid metal between the rotor and the stator of the device of claim 1.

16. A method for preparing metal matrix composites (MMCs) by introducing solid particles to a liquid metal, and shearing the liquid metal between the rotor and the stator of the device of claim 1.

17. A method for preparing metal matrix composites (MMCs) by introducing an active gas to a liquid metal, and shearing the liquid metal between the rotor and the stator of the device of claim 1.

18. A method for mixing immiscible liquid metals by introducing one immiscible liquid metal to another liquid metal, and shearing the liquid metal between the rotor and the stator of the device of claim 1.

19. A method for continuously or semi-continuously direct chill (DC) casting ingots or slabs including the step of shearing molten metal in a sump of a DC caster between the rotor and the stator of the device of claim 1.

* * * * *